United States Patent [19]

Ohzeki et al.

[11] Patent Number: 5,034,777

[45] Date of Patent: Jul. 23, 1991

[54] TRANSFERRING DEVICE HAVING CHARGING DEVICE WITH DOUBLE OXIDE AND VOLTAGE CONTROL

[75] Inventors: Yukihiro Ohzeki, Kashiwa; Koichi Hiroshima; Yoshiaki Nishimura, both of Yokohama; Jun Murata, Kawagoe; Junji Araya; Tatsunori Ishiyama, both of Yokohama; Yasushi Sato; Kimio Nakahata, both of Kawasaki, all of Japan

[73] Assignee: Canon Kabushiki Kaisha, Tokyo, Japan

[21] Appl. No.: 537,785

[22] Filed: Jun. 14, 1990

[30] Foreign Application Priority Data

Jun. 20, 1989 [JP] Japan ..... 1-159077

[51] Int. Cl.[5] ..... G03G 15/16

[52] U.S. Cl. ..... 355/274; 355/275; 355/277

[58] Field of Search ..... 255/274, 271, 275, 276, 255/277, 273, 208, 202, 278, 279, 280, 281

[56] References Cited

U.S. PATENT DOCUMENTS 3,781,105 12/1973 Meagher ..... 355/274
3,924,943 12/1975 Fletcher ..... 355/274
3,937,572 2/1976 Gaynor et al. ..... 355/217
3,954,333 5/1976 Goel ..... 355/273
4,190,348 2/1980 Friday ..... 355/274
4,379,630 4/1983 Suzuki ..... 355/274

*Primary Examiner*—A. T. Grimley
*Assistant Examiner*—Thu Dang
*Attorney, Agent, or Firm*—Fitzpatrick, Cella, Harper & Scinto

[57] ABSTRACT

An image forming apparatus includes a movable image bearing member; an image forming device for forming an image on the image bearing member; a transfer device for transferring an image from the image bearing member to a transfer material at a transfer position, wherein the transfer device is contactable to a backside of the transfer material at the transfer position and includes a charging member including a double oxide and a voltage source for applying a voltage to the charging member, and wherein the voltage source constant-voltage-controls the charging member when an image region of the image bearing member is at the transfer position, and constant-current-controls the charging member in at least a part of a period when the image region of the image bearing member is not at the transfer position, wherein a constant voltage for the constant voltage control is determined on the basis of the constant current control.

35 Claims, 9 Drawing Sheets

TRANSFERRING DEVICE HAVING CHARGING DEVICE WITH DOUBLE OXIDE AND VOLTAGE CONTROL

FIELD OF THE INVENTION AND RELATED ART

The present invention relates to an image forming apparatus such as an electrostatic copying machine or printer using an electrostatic image transfer process.

An image forming apparatus is known which comprises an image bearing member and a charging member press-contacted thereto to form a nip therebetween, through which a transfer material is passed while the charging member is supplied with a bias voltage, by which the toner image is transferred from the image bearing member to the transfer material.

In such an apparatus, the charging member is usually in the form of a roller or belt. The material thereof is rubber or resin material in which conductive filler material such as conductive carbon, graphite or metal powder in the matrix thereof to adjust the resistivity, or rubber or resin material in which plasticizer, low molecular weight liquid rubber or surface active agent is added in the matrix thereof to adjust the resistivity, or silicone rubber material in which particulated bridged silicone rubber containing carbon black is dispersed to adjust the resistivity. Another example of the transfer roller has a multilayer structure including a low resistance layer having a resistivity of not more than $10^4$ ohm.cm which is considered as being relatively stable and a high resistance layer having a resistivity of not less than $10^{10}$ ohm.cm.

Referring first to FIG. 10, there is shown a typical example of an image forming apparatus.

A photosensitive member 1 is in the form of a cylinder rotatable about an axis perpendicular to the sheet of the drawing in the direction indicated by an arrow X. The surface of the photosensitive member 1 is uniformly charged by the charging roller 3 supplied with the electric power from the power source 14, to a negative polarity, for example. Thereafter, image information writing means 5 applied image information through a slit or by imagewisely modulated laser beam on the charged surface of the photosensitive member, so that an electrostatic latent image is formed.

Then, a negative toner, for example, is supplied to the latent image by the developing device 6, by which a toner image is formed by the reverse development.

With the continued rotation of the photosensitive member 1, the toner image reaches a nip formed between the photosensitive member 1 and a transfer roller 2 (charging member) press-contacted thereto. The nip constitutes the image transfer station (position). At the same time, a transfer material P reaches the transfer position in timed relation with the toner image. The transfer roller 2 at this time is supplied with a positive, for example, image transfer bias, so that the electric charge having the polarity opposite to the toner is applied to the backside of the transfer material, by which the toner image is transferred from the photosensitive member 1 to the transfer material P. In the shown apparatus, the photosensitive member is of an OPC (organic photoconductor) photosensitive member. The process speed is 23 mm/sec. The charging means is in the form of a charging roller 3 rotatably press-contacted to the photosensitive member 1 and supplied with a DC biased AC voltage to the negative polarity. The transfer means is in the form of a transfer roller 2 rotatably press-contacted to the photosensitive member 1 to apply a positive electric charge to the backside of the transfer material. The transfer roller 2 is made of the material described above. In consideration of the improved image transfer performance and the damage by the image transfer electric field to the photosensitive member under the low humidity condition, the resistivity of the transfer roller 2 is preferably $10^6$ ohm.cm–$10^{12}$ ohm.cm (semi-conductive region).

FIG. 11 shows the sequence of the operation of the apparatus.

In the image forming apparatus of the above-described image transfer system is advantageous from the standpoint of the cost as compared with the corona discharger type, since a high voltage source is not required. The additional advantages include no contamination of an electrode wire and no adverse effects thereof, no production of the ozone or the nitride due to the high voltage discharge, no deterioration of the photosensitive member and the image quality attributable to the products. However, the following problems have been found. One of them is that it is difficult to produce with stability the transfer roller having the desired resistivity when the conventional materials are used.

In the case of the rubber or the resin in which the conductive filler such as the conductive carbon, graphite or metal powder is dispersed to adjust the resistivity of the transfer roller, as described in the foregoing, there are following problems. As is known, in the semi-conductive region, the resistance changes steeply relative to the quantity of the conductive filler. Therefore, a slight difference in the dispersion due to the loss of the conductive filler by the external scattering during the mixture of the conductive filler, results in a significant change in the electric resistance. Therefore, the reproducibility is poor, which is a significant problem to the stability in the mass-production of the transfer roller.

In the case where the stability is intended to be provided in the semi-conductive region by addition of plasticizer, low molecular weight liquid rubber or surface active agent in the transfer roller, there are following problems. The plasticizer, the low molecular weight liquid rubber or the surface active agent oozes from the surface of the transfer roller externally, and is transferred to the photosensitive member to contaminate it with the result of poor image quality attributable to the improper charging of the photosensitive member. By the ooze of the plasticizer, the low molecular weight liquid rubber or the surface active agent on the surface of the roller significantly increases the stickiness, and as a result, the toner particles and the paper dust are deposited thereon, and the function of the roller is deteriorated.

In the case of the particulated bridged silicone rubber containing carbon black is dispersed in the silicone rubber as disclosed in the Japanese Laid-Open Patent Application No. 156858/1988, the manufacturing cost is high. In the case of the multilayer structure using the low resistance layer having the resistivity not more than $10^4$ ohm.cm which is considered as being relatively stable and a high resistance layer to virtually providing the semiconductor region, there are following drawbacks. For example, when a high resistivity plastic resin layer having the resistivity of $10^{10}$–$10^{12}$ ohm.cm is applied on the conductive rubber having the resistivity of not more than $10^4$ ohm.cm, the resistivity is dependent on the film thickness of the outer layer or the bonding property therebetween, and therefore, the control thereof is significant, and the manufacturing process is complicated with the result of high cost, and therefore, it is difficult to make it practical.

Another problem is that the relation between the voltage applied to the transfer roller 2 and the current flowing therethrough (V-I characteristics) significantly changes depending on the ambient conditions.

The resistance of the transfer roller under a low temperature and low humidity condition (15° C. and 10%) which will hereinafter be called "L/L" condition increases by several orders from that under the normal temperature and normal humidity condition (23° C. and 64%) which will hereinafter be called "N/N" condition. On the contrary, the resistance under a high temperature and high humidity condition (32.5° C. and 85%) which will hereinafter be called "H/H" condition decreases by one or two orders from that under the N/N condition.

FIG. 12 shows the change in the V-I characteristics depending on the ambient conditions. In this Figure, the solid lines represent the V-I characteristics of the transfer roller under the L/L, N/N and H/H conditions in the absencen of the transfer material in the transfer position. The absence of the transfer material occurs, for example, during the prerotation period in which the photosensitive member is rotated for the preparation of the image forming operation; during the post-rotation in which the photosensitive member rotates after the image transfer operation; or during the sheet interval which is after the completion of an image transfer operation for one transfer material after image formation start is instructed and before the start of the image transfer operation for the next sheet, in the continuous mode for continuously transferring the images on the sheets. In this Figure, the region of the image bearing member in the transfer position has already been charged by the charging roller 3 supplied by a DC biased AC voltage.

The broken lines represent the V-I characteristics of the transfer roller 2 under the same various conditions when the transfer material of A4 size passes through the transfer position.

It has been found in this apparatus through experiments that in order to perform the good transfer operation, the transfer current when the sheet is present in the transfer position is 0.5–4 micro-amperes, and that if it is larger than 5 micro-amperes, an image transfer memory of positive potential remains in the OPC photosensitive member with the result that the resultant image has foggy background.

Therefore, it is understood that the proper transfer bias in this apparatus is different depending on the ambient conditions under which the apparatus is placed, and that the proper transfer bias voltages are approximately 300–500V under the H/H condition, approximately 400–750V under the N/N condition, and approximately 1250–2000V under the L/L condition. When a constant voltage control is effected in this apparatus, the following problems arise.

When the transfer roller is constant-voltage-controlled at 500V in order to provide the proper image transfer under the N/N condition, for example, the similar good transfer performance can be obtained under the H/H condition, but under the L/L condition, the transfer current is zero with the result of improper image transfer operation.

If the voltage is set at 2000V, for example, in an attempt to improve the image transfer performance under the L/L condition, the positive transfer memory remains in the OPC photosensitive member during the absence of the sheet in the transfer station under the N/N and H/H conditions, with the result that the resultant image has foggy background. Particularly under the H/H condition, the transfer current increases also during the sheet present period, and therefore, the electric charge penetrates through the transfer material to charge the negative toner on the surface of the photosensitive member to the opposite polarity, with the result of improper image transfer performance. In an attempt to solve these problems, if the constant current control is effected, the following problems arise.

Generally, the apparatus of this type is capable of accepting a transfer material (sheet) having a size smaller than the maximum usable size. Therefore, when a small size transfer sheet is used, some portion of the transfer material is directly contacted to the transfer roller without the sheet therebetween. In the above-described known apparatus, if the constant current control is effected at 1 microampere, the electric current flowing through a unit area of the sheet absent portion is substantially the same as the electric current per unit area when 1 micro-ampere flows during the sheet absence period such as the pre-rotation period, the post-rotation period or the sheet interval period. Therefore, the voltage across the transfer roller drops with the result that hardly any current flows through the sheet present region, and therefore, the image transfer performance is not proper.

In this case, when a usual size envelope or smaller sheet is used, the transfer current is smaller than when the A4 size sheet is used, by 200V or slightly higher under the H/H condition, by 200V or slightly smaller under the N/N condition and by approximately 400V under the L/L condition, and therefore, the current flowing through the transfer material is substantially zero with the result of improper image transfer.

If the transfer current is increased in an attempt to obtain proper image transfer performance for the use of the small size sheet, the current density becomes large through a relatively narrow sheet absent portion such as the difference between the letter size sheet and the A4 size sheet, with the result that the image transfer memory remains on the surface of the photosensitive member, and therefore, the background of the image becomes foggy, and the backside of the next letter size sheet is contaminated.

Accordingly, in the apparatus of this type, it is difficult to provide good image transfer performance for any size of the transfer material under any condition, by employing either the constant voltage control or the constant current control.

As described in the foregoing, despite the various attempts having been made, it has been difficult to put the contact type image transfer method into practice because of the problem with the production of the transfer roller having the semiconductivity property and the problem of the variation in the resistance of the transfer roller depending on the ambient humidity, and therefore, the problem that the stable image transfer performance is not obtained under all conditions.

SUMMARY OF THE INVENTION

Accordingly, it is a principal object of the present invention to provide an image forming apparatus wherein the satisfactory image transfer performance can be stably provided under any ambient conditions and irrespective of the size of the transfer material.

It is another object of the present invention to provide an image forming apparatus suitable for mass-production.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The embodiments of the present invention will be described in conjunction with the accompanying drawings.

Figure 1:
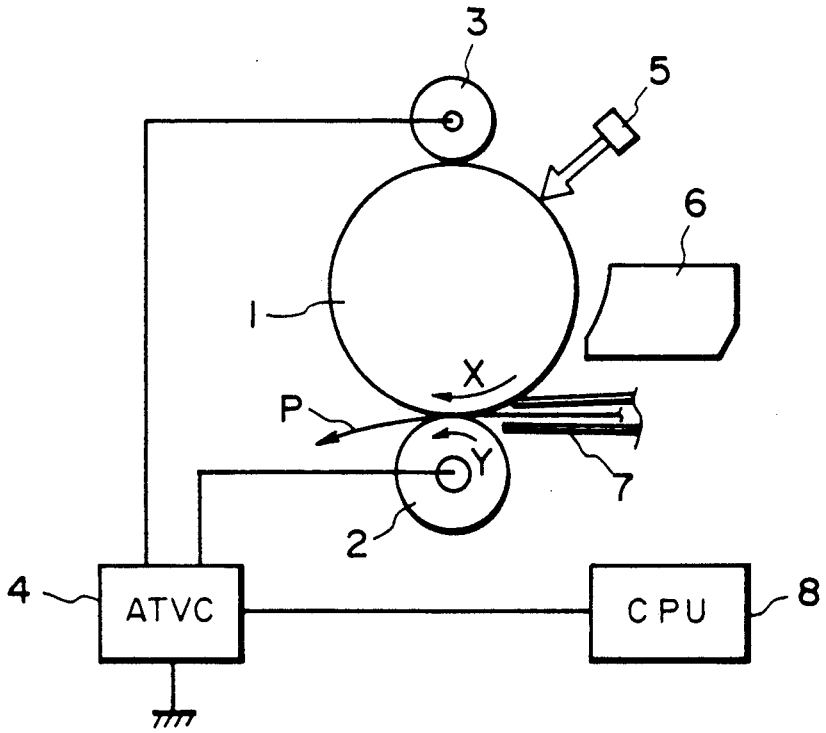
FIG. 1 is a sectional view of an image forming apparatus according to an embodiment of the present invention.

FIG. 1 shows an image forming apparatus suitable for use of the present invention. In this apparatus, the surface of the OPC photosensitive member 1 having a diameter of 30 mm rotates at the process speed of 23 mm/sec (peripheral speed) in the direction indicated by an arrow X, is uniformly charged to the negative polarity by a charging roller 3. The charged surface is exposed to an imagewisely modulated laser beam, by which the potential of the exposed portion is attenuated, so that an electrostatic latent image is formed.

With the rotation of the photosensitive member 1, the latent image reaches a developing device 6, where the latent image is supplied with negatively charged toner so that a toner image is formed through the reverse-development in which the toner is deposited on the potential attenuated portion.

There is an image transfer roller 2 downstream of the developing device with respect to the peripheral movement direction of the photosensitive member 1. The transfer roller 2 is press-contacted to the photosensitive member 1 and is semi-conductive, as will be described hereinafter. By the press-contact therebetween, a nip is formed which provides an image transfer position.

When the toner image reaches the transfer position, a transfer material P is supplied to the transfer position along the conveyance passage 7 in timed relation with the arrival of the toner image. The transfer roller urges the transfer material at the backside thereof to the photosensitive member, while rotating in the direction Y. Since the transfer roller is supplied with a positive transfer bias, the toner image is transferred from the surface of the photosensitive member to the transfer material.

To the charging roller 3 and the transfer roller 2, the proper voltage is applied at proper times from a voltage source 4 capable of effecting a constant voltage control and a constant current control (ATVC, Active Transfer Voltage Control).

In this embodiment, the semiconductive property of the transfer roller 2 is given in the following manner Here, the semiconductivity means that the volume resistivity of the roller is $10^6$–$10^{13}$ ohm.cm. If the volume resistivity of the transfer roller 2 is smaller than $10^6$ ohm.cm, the resistance of the transfer material is too high under the L/L conditions with the result of improper image transfer. If it is larger than $10^{13}$ ohm.cm, the transfer current becomes so small that the image transfer is also improper. Therefore, it is desirable that the transfer roller has the semiconductivity.

More particularly, the transfer roller 2 used in this embodiment comprises double oxide in the elastic member for the purpose of providing the semiconductivity.

The transfer roller 2 in this embodiment contains in the elastic member the double oxide, 0.1–20% by weight of carbon black and 5–20% by weight of insulative oil.

The double oxide used in the present specification refers to a solid solution compound of at least two species of oxides, and is different from a simple metal oxide. Specific examples of such a double oxide may include: solid solution compounds comprising zinc oxide (ZnO) and aluminum oxide ($Al_2O_3$); solid solution compounds comprising tin oxide ($SnO_2$) and antimony oxide ($Sb_2O_5$); solid solution compounds comprising indium oxide ($In_2O_3$) and tin oxide ($SnO_2$). At least one of such double oxides may be contained in the transfer roller.

Such a double oxide may be characterized in that the respective metals contained therein have similar atomic radii and constitute a substitutional solid solution, and their valences are different, whereby the double oxide provides an electro-conductivity which cannot be provided by each metal oxide alone.

The above-mentioned double oxide may preferably have a specific resistance (or resistivity) of $10^1$ ohm.cm to $10^3$ ohm.cm, which is higher than that of electroconductive carbon black, reinforcing carbon black, ruthenium oxide, etc. (i.e., $10^{-2}$ ohm.cm to $10^0$ ohm.cm); and is lower than that of zinc oxide, aluminum oxide, antimony oxide, indium oxide, tri-iron tetroxide, tin oxide, etc. (i.e., $10^4$ ohm.cm or higher).

When the filler comprising a double oxide according to the present invention which has a specific resistance of $10^1$ to $10^3$ ohm.cm is used, a stable semiconducting property is provided by using an addition amount which causes substantially no problem in physical properties, whereby the resultant semiconducting material is excellent in reproducibility and stability in mass-production.

On the other hand, in the case of the conventional filler to be dispersed in a dispersion medium such as polymer, when the filler has a specific resistance of below $10^1$ ohm.cm, the addition amount thereof provides a region wherein the resistance is abruptly changed, with the result that the resultant dispersion is poor in reproducibility and stability in mass-production, as described hereinbefore.

Further, in a case where the conventional filler has a specific resistance of above $10^3$ ohm.cm, a considerably large addition amount thereof is required in order to obtain a semiconducting property, whereby the dispersing operation becomes difficult. Even if such a large amount of the filler is dispersed in a dispersion medium, the physical property of the resultant dispersion becomes considerably poor and cannot reach a practically acceptable level. In such a case, the hardness of the resultant dispersion becomes considerably high so that it cannot provide a sufficient and stable contact state in combination with a photosensitive member, etc.

Among the above-mentioned double oxides, ZnO $Al_2O_3$ is particularly preferred for some reasons such that: the filler comprising such a double oxide may provide a specific resistance of $10^2$ to $10^3$ ohm.cm which is nearest to an ideal value in view of resistance stability in the semiconductive region; it may easily be dispersed in a polymer dispersion medium such as resin and rubber, and the resultant dispersion is excellent in moldability; it may be produced at a low cost; an appropriate resistance value may obtained by changing the doping amount of Al (or $Al_2O_3$); etc.

The double oxide content in an elastomeric composition may preferably be 5–40 wt. %, more preferably 10–30 wt. %, based on the total weight of the elastomeric composition (inclusive of the double oxide per se).

In the case wherein the charging member also has a function of conveying a transfer material such as paper, as in the case of a roller-type (or roller-form) charging member for transfer, the material per se constituting the charging member is required to have a sufficient mechanical strength such as wear resistance. In such a case, a reinforcing agent may preferably be used in combination with the above-mentioned double oxide.

As the reinforcing agent, reinforcing carbon such as carbon black, silica, etc., may appropriately be used. In the case of carbon black, it has been found that an excellent reinforcing property and a stable resistance may be obtained at a specific resistance of $10^0$ ohm.cm or higher of the carbon black, and an addition amount of 0.1–20 wt. %, further preferably 1–15 wt. % based on the total weight of the composition (inclusive of the reinforcing agent per se). When the specific resistance is lower than $10^0$ ohm.cm, the conducting ability is too great, and potential unevenness is liable to occur even in a small addition amount of the carbon black. When the addition amount exceeds 20 wt. %, the resistance is liable to depend more on the carbon black than on the double oxide, whereby the addition of the double oxide becomes less meaningful.

In the present invention, the carbon black may be those usable for general industry. Specific examples thereof may include those referred to as: ISAF (Intermediate Super Abrasion Furnace), SAF (Super Abrasion Furnace), HAF (High-Abrasion Furnace Black), FEF (Fast Extrusion Furnace), SRF (Semi-Reinforcing Furnace), FT (Fine Thermal), EPC (Easy Processing Channel), MPC (Medium Processing Channel), etc.

In the case of a roller-type charging member for transfer or primary charging, the charging member may provide good charging or transfer characteristic free of unevenness, when the charging member retains a sufficient contact area with a photosensitive member under pressure. Accordingly, when the charging member is used for such a purpose, it may preferably have a particularly low hardness.

In such a case, a process oil such as insulating oil may preferably be used. As a result of my investigation of various insulating oils, it has been found that a low hardness, an excellent reinforcing property and a stable resistance may be obtained at a specific resistance thereof of $10^{12}$ ohm.cm or higher, and an addition amount of 5–20 wt. % more preferably 8–16 wt. %, based on the total weight of the composition (inclusive of the oil per se). In the case that an insulating oil having a specific resistance of below $10^{12}$ ohm.cm is used, when the oil migrates to a photosensitive member, the potential on the photosensitive member is changed only in the portion to which the oil has migrated, thereby to impair the resultant copied image or to invite toner agglomeration on the photosensitive member. When the addition amount exceeds 20 wt. %, the exudation of the oil to the charging member surface becomes marked to contaminate the photosensitive member, and the attachment of toner particles and paper dust also becomes marked, whereby the function of the charging member is liable to be deteriorated.

Preferred examples of such an insulating oil may include paraffin oils and mineral oils.

Specific examples of the elastomeric (or elastic) material used in the present invention may include: rubbers such as EPDM (ethylene-propylene-diene terpolymer), polybutadiene, natural rubbers, polyisoprene, SBR (styrene-butadiene rubber), CR (chloroprene rubber), NBR (nitrile-butadiene rubber), silicone rubber, urethane rubber, and epichlorohydrin rubber; thermoplastic elastomers including RB (butadiene rubber), polystyrene-type such as SBS (styrene-butadiene-styrene elastomer), polyolefine-type, polyester-type, polyurethane-type and polyvinyl chloride; and polymer materials such as polyurethane, polystyrene, polyethylene, polypropylene, polyvinyl chloride, acrylic resins, styrene-vinyl acetate copolymers, and butadiene-acrylonitrile copolymers.

The elastomeric material may be used in the form of either a foam (or foamed material) or a solid rubber.

Further, another filler may be added to the elastomeric material as desired. Specific examples thereof may include: calcium carbonate, various clays, talc, or blends of these; and silica-type fillers such as hydrous silicic acid, anhydrous silicic acid, and salts of these.

In the present invention, a foaming agent (or blowing agent) may be used. Specific examples thereof may include: ADCA (azodicarbonamide), DPT (dinitrosopentamethylenetetramine), OBSH (4,4'-oxybis(-benzenesulfonylhydrazide), TSH (p-toluenesulfonylhydrazide), AIBN (azobisisobutyronitrile), etc. When a blend of ADCA and OBSH is used, a foam of tight vulcanization (i.e., foam having a high degree of cross-linking) may be obtained.

In the case of a polymer such as certain type of urethane rubber and silicone rubber which is capable of changing the strength or softness of the material by regulating the polymer structure thereof of the polymer per se, it is sufficient to add a double oxide alone to the polymer. When such a polymer is used, hardness and strength requisite for practical use may be attained even without using reinforcing filler such as carbon black or softener.

In the present embodiment, the specific resistance of powder is measured by a general method of measuring powder resistance at a load of 1.5–2 kg.

The shape or form of the charging member according to the present invention may for example be a roller, a blade, etc., and may appropriately be selected corresponding to the specification and/or form of an electrophotographic apparatus using it.

Figure 3:
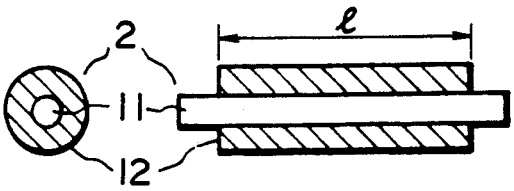
FIG. 3 is a sectional view of an image transfer roller usable with the image forming apparatus of FIG. 1.

FIG. 3 shows a basic structure of a roller-form charging member 2 according to the present embodiment. The charging member 2 comprises a cylindrical electroconductive base 11 having a diameter of 6 mm ; and an elastomeric (or elastic) layer 12 formed thereon. The elastomeric layer 12 comprises an elastomeric (or elastic) material and a double oxide contained therein. The roller 2 has a diameter of 17 mm, and a length substantially equal to the length of the short side of an A4 size sheet. Where the charging member is in the form of a blade, such a charging member may comprise an electroconductive base in the form of a plate, and an elastomeric layer formed thereon containing a double oxide.

The electroconductive substrate 2 may comprise a metal or metal alloy such as iron, copper and stainless steel; or an electroconductive resin, etc.

In the foregoing manner, a semi-conductive transfer roller 2 can be stably produced. An example of the roller produced in such a manner will be described.

A formulation comprising: 100 wt. parts (hereinafter, simply referred to as "part(s)") of an EPDM (trade name: EPT 4045, mfd. by Mitsui Sekiyu Kagaku) as a polymer dispersion medium, 10 parts of zinc white (Zinc White No. 1, mfd. by Tokyo Kasei), 2 parts of stearic acid, 2 parts of an accelerator "M" (trade name: Nocceler M, mfd. by Ouchi-Shinko Kagaku), 1 part of an accelerator "BZ" (trade name: Nocceler BZ, mfd. by Ouchi-Shinko Kagaku), 2 parts of sulfur, 5 parts of a foaming agent (trade name: Cellmic C, mfd. by Sankyo Kasei), 5 parts of a foaming aid (trade name: Cellton NP, mfd. by Sankyo Kasei); and a reinforcing agent, an insulating oil and another additive as shown in the following Table 1 each in an amount as shown in Table 1 was uniformly dispersed and kneaded by means of a twin-roller device at normal (or room) temperature.

The resultant rubbery kneaded product was wound about a metal core of iron having a diameter of 6 mm and a length of 250 mm, onto which a synthetic rubber-type primer had been applied, and the resultant product was charged into a mold, and preformed at 40° C. and 100 kgf/cm$^2$. The resultant product was vulcanized by steam vulcanization (160° C., 30 min) and then subjected to abrasion machining, whereby five species of roller-form charging members A to E were prepared. The resultant charging member had an outside diameter of 16 mm and the rubber layer thereof had a length of 230 mm.

The resistance of the charging member was measured by disposing the charging member on an aluminum plate, applying a load of 500 g to each end of the charging member (total load: 1 kg), and measuring the resistance between the metal core of the charging member and the aluminum plate under a condition of 23° C. and 50% RH.

TABLE 1

| Additive | Transfer roller (parts) | | | | |
|---|---|---|---|---|---|
| | A | B | C | D | E |
| Reinforcing agent HAF carbon (Asahi #70, mfd. by Asahi Carbon) | | 45 | 50 | 45 | |
| Reinforcing agent FEF carbon (Asahi #60, mfd. by Asahi Carbon) | 20 | | | | 30 |
| Insulating oil Paraffin oil $1 \times 10^{14}$ ohm · cm | 70 | 60 | 65 | 55 | 40 |
| Ketjen Black EC (Lion-Akzo) 0.1 ohm · cm | Variable | | | | |
| $ZnO.Al_2O_3$ (double oxide) (23K-S mfd. by Hakusui Kagaku) 200 ohm · cm | | Variable | Variable | Variable | |
| $Fe_3O_4$ $2 \times 10^5$ ohm · cn | | | | | Variable |

Figure 4:
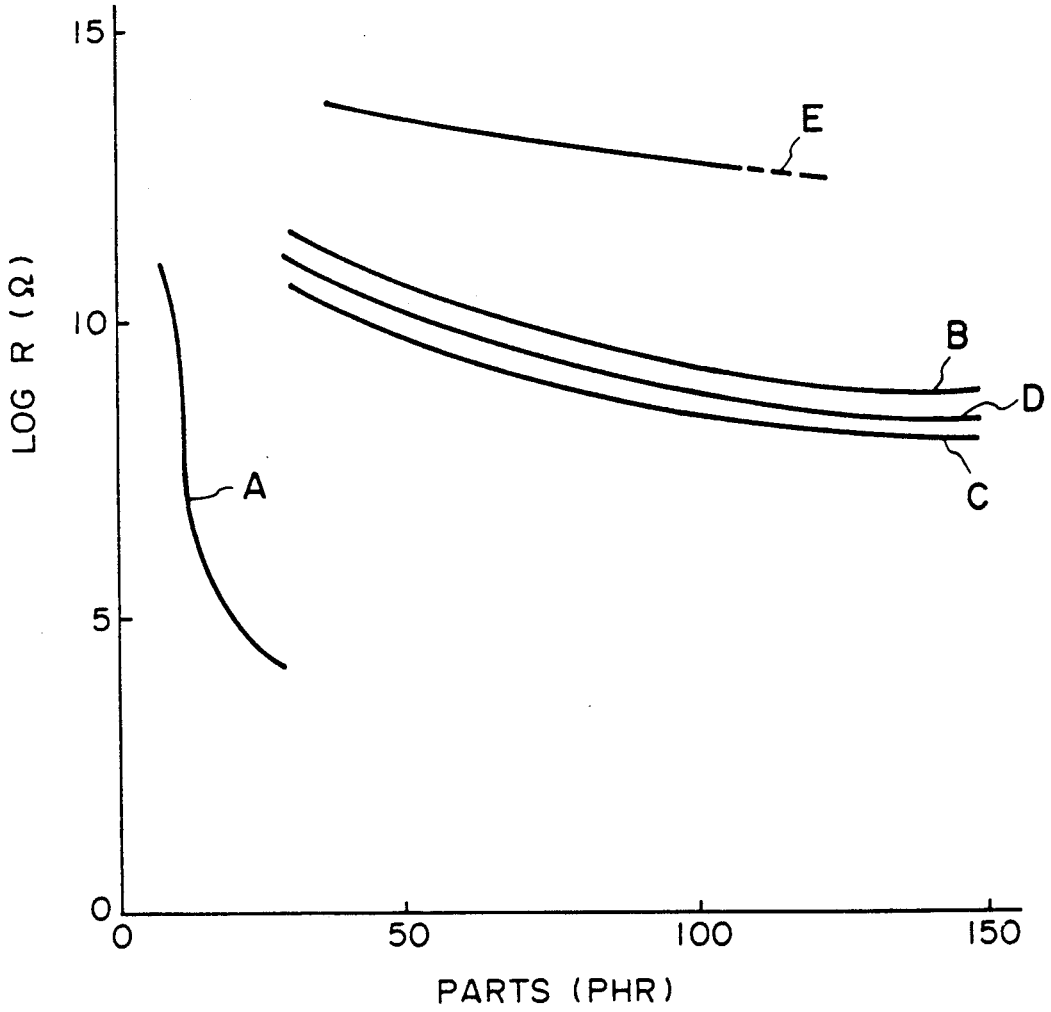
FIG. 4 is a graph showing the resistivity of the transfer roller relative to the parts of the additive to the transfer roller.

FIG. 4 is a graph showing a relationship between the thus obtained resistance of each charging member and the addition amount of each filler.

As apparent from FIG. 4, in a predetermined semi-conductive region, when a double oxide of ZnO $Al_2O_3$ was added to the composition, variations in the resistance corresponding to changes in the addition amount were little, and a desired stable resistance value could arbitrarily be obtained.

Further, a stable resistance value could arbitrarily be obtained by changing the ratio between the addition amount of the reinforcing carbon and that of the insulating oil.

Further, a reproducibility test for the resistance value was conducted with respect to the respective compositions. In case of the electroconductive carbon (Ketjen Black EC), the resistance varied from $5 \times 10^7$ to $5 \times 10^{10}$ ohm. (i.e., in a range corresponding to three figures), when a resistance of $10^9$ ohm. was intended by using the carbon in an amount of 12 phr (parts per 100 parts of the total weight of the composition including the additive such as the carbon per se).

On the other hand, in the case of the ZnO $Al_2O_3$ double oxide, the resistance varied in the range of from (intended value)$\times$1.125 to (intended value)$\times$0.875, i.e., in a range corresponding to $\frac{1}{4}$ of the intended value. It was found that such variations were substantially within measurement tolerance.

As described in the foregoing, according to this embodiment, one of the problems with the conventional apparatus, that is, the difficulty in the mass-production of the transfer member having a semiconductive region resistance, has been solved to make it possible to produce the semiconductive transfer roller with stability.

However, in order to put the contact image transfer method into practice, another problem, that is, the instability in the transfer performance relating to the resistance variation of the transfer roller 2 depending on the ambient humidity, has to be solved.

In the present invention, the invention disclosed in Japanese Patent Application No. 276106/1988 assigned to the assignee of this application is employed to solve said another problem. This will be described in detail in conjunction with the above transfer roller.

The transfer roller described above is used in the image transfer system which is controlled by the ATVC system.

Figure 7:
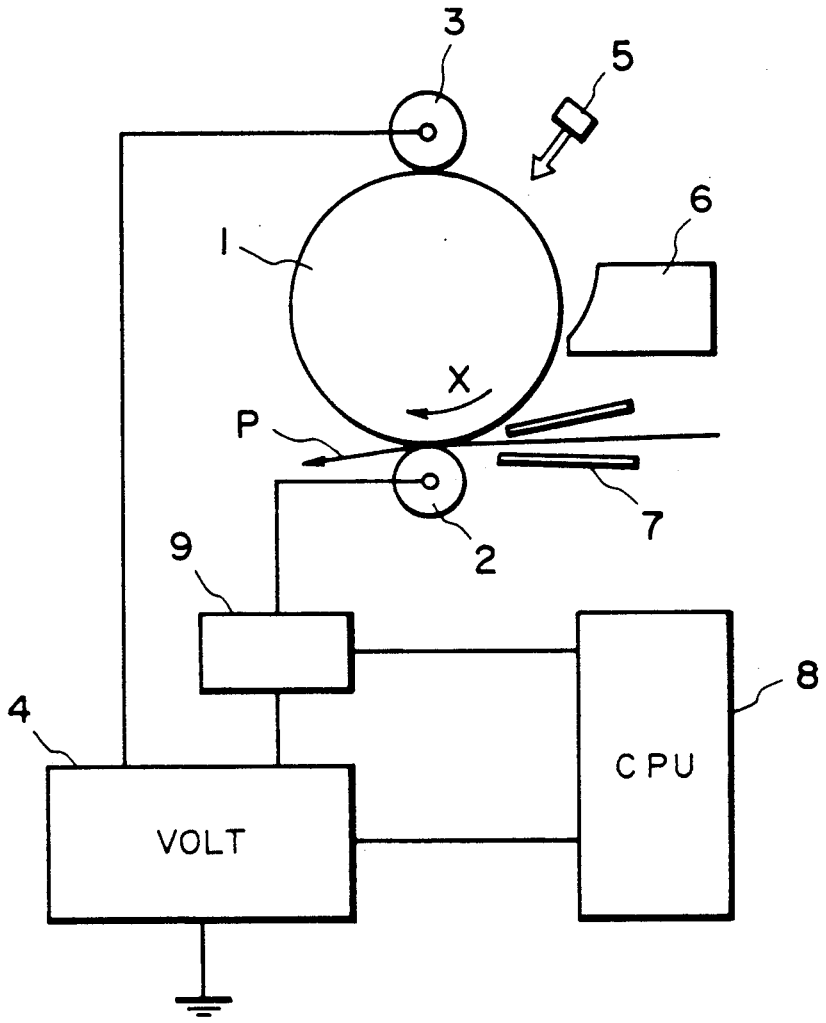
FIG. 7 is a sectional view of an image forming apparatus according to another embodiment of the present invention.

As shown in FIG. 7, when a printing signal for the start of the image forming operation is received by the CPU 8 from the external apparatus such as a computer, the CPU 8 supplies an actuation signal for the main motor to the motor driving circuit (not shown) for driving the photosensitive member 1, and simultaneously it supplied a primary high voltage actuating signal to the voltage source 4 to apply the charging bias to the charging roller 3 so as to charge the surface of the photosensitive member 1 having the negative charging polarity and made of OPC to a dark potential Vd = −700V.

Then, the CPU 8 drives the image information writing means 5 (for example, a laser scanner) to project the light in accordance with an image signal onto the charged photosensitive member, so that an electrostatic latent image is formed thereon.

Then, the CPU 8 supplies an image transfer operation start signal to the voltage source 4, upon which the power source 4 effects the constant voltage control and the constant current control to the transfer roller 2, which will be described hereinafter.

The voltage source 4, upon reception of the transfer operation start signal, the constant current control is effected to the transfer roller when the non-image area of the photosensitive member which does not have the latent image, and therefore, the toner image is in the transfer position. Thus, the constant current control of the transfer roller 2 is effected to the transfer roller before the start of the image transfer operation, that is, when the transfer material is not present in the transfer position where the photosensitive member and the transfer roller are contacted. In the apparatus of this embodiment, the constant current is 5 micro-amperes.

The voltage source 4 detects the voltage corresponding to the voltage which is produced across the transfer roller 2 during the constant current control period. Then, the constant current control is stopped, and when the latent image formed portion of the photosensitive member reaches the transfer position, the constant voltage control (ATVC control) is effected to the transfer roller 2 with the voltage corresponding to the detected voltage. Thus, the constant voltage control is effected to the transfer roller 2 when the transfer material is present in the transfer position.

Figure 5:
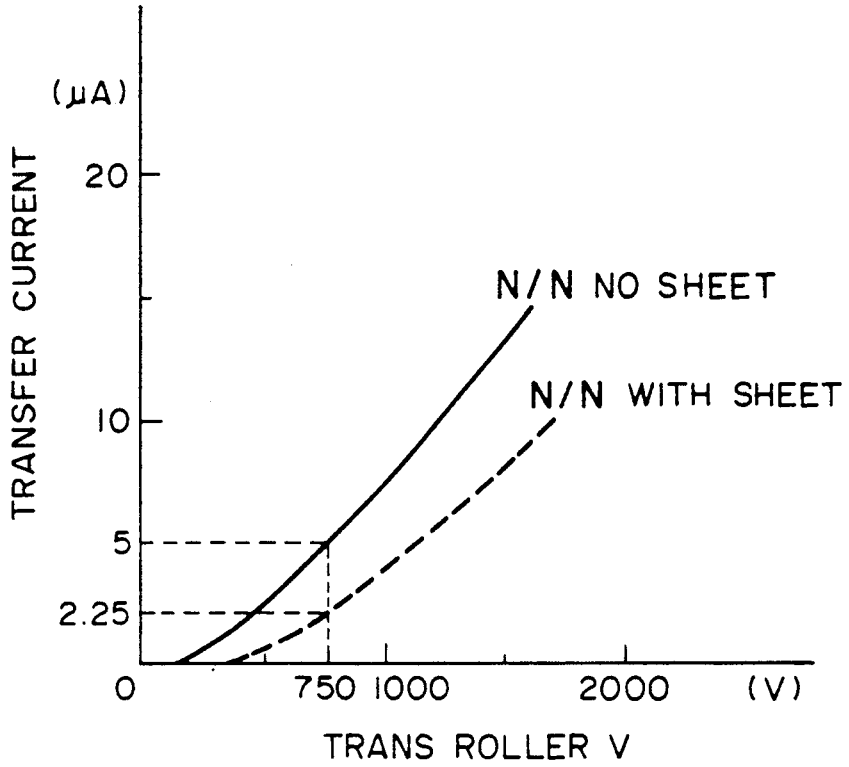
FIGS. 5 and 6 are graphs illustrating the V-I characteristics of the semiconductor transfer roller.

Referring to FIG. 5, the description will be made in conjunction with the V-I characteristics of the transfer roller under the N/N condition. When the potential of the region of the photosensitive member in the transfer position when the sheet is absent is Vd, the voltage required for flowing the transfer current of 5 micro-amperes is approximately 750V (positive). With this voltage, the transfer current when the sheet is present is approximately 2.25 micro-amperes.

By controlling the voltage and the current of the transfer roller in the manner described above, the constant voltage control is effected to the transfer roller at 750V in the presence of the transfer sheet under the N/N condition, by which the current of 2.25 micro-amperes flows through the transfer roller so that the good transfer operation can be performed.

Figure 2:
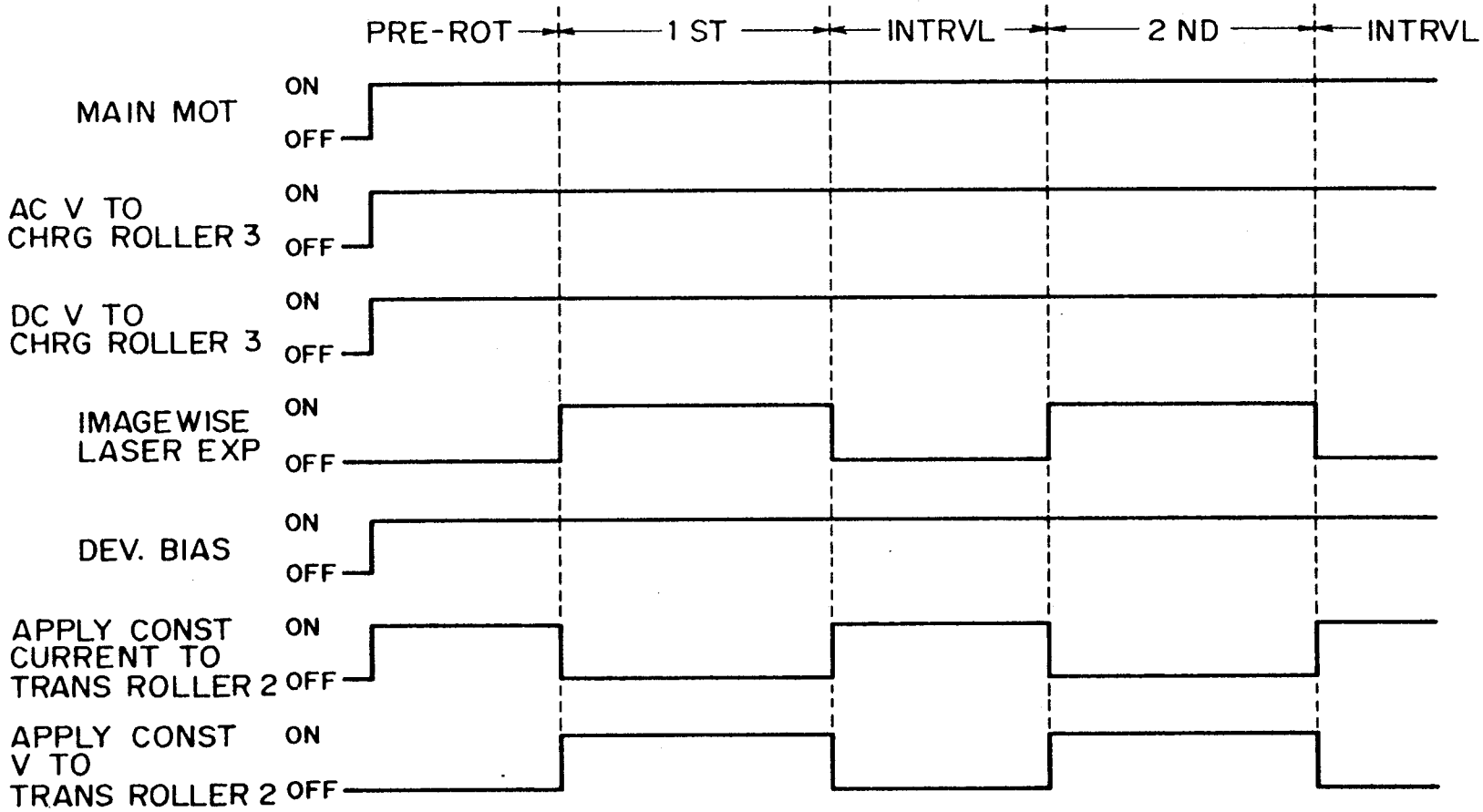
FIG. 2 is a timing chart relating to the operation of the apparatus of FIG. 1.

In the case of the continuous image forming operations wherein the image forming operations are repeated continuously on plural transfer materials after production of the image formation start signal, as will be understood from the timing chart of FIG. 2. The constant current control is effected when the sheet is absent in the transfer position, that is, when the non-image area of the photosensitive member is in the transfer position; and when the sheet is present in the transfer position, that is when the image area of the photosensitive member is in the transfer position, the constant voltage control is effected.

Figure 6:
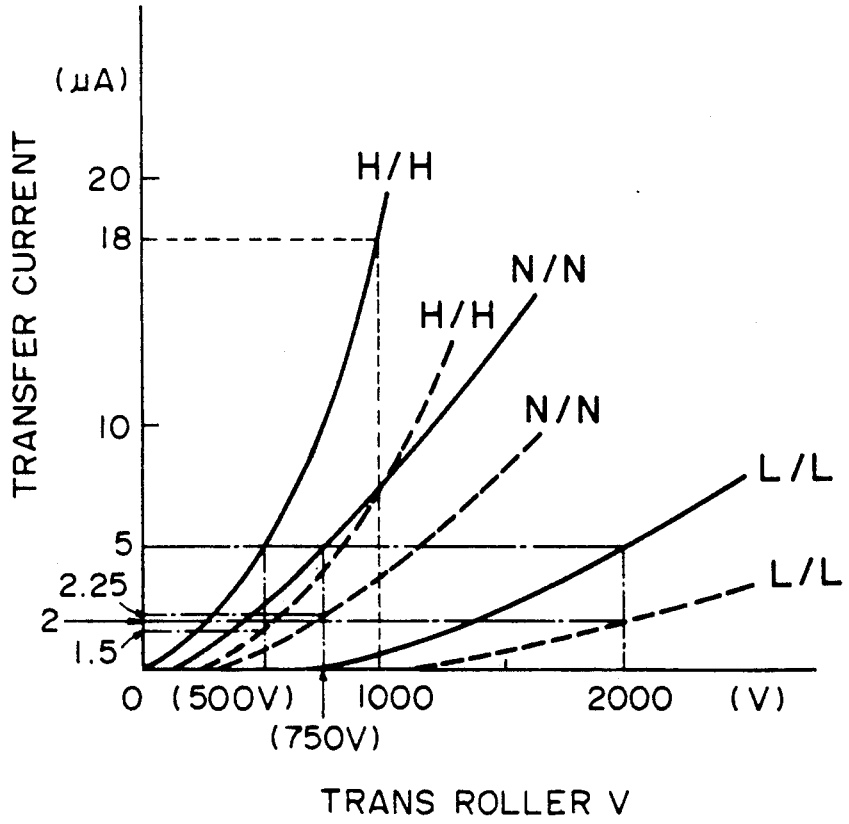

Referring to FIG. 6, the description will be made as to the functions under the various temperature and humidity conditions of the ambience when the above-described control system is employed.

Under the H/H condition, the constant current control of 5 micro-ampere is effected to the transfer roller 2 by the voltage source 4 during the sheet absent period. Then, the voltage of the transfer roller 2 is 500V, which is detected, and the constant voltage control with the 500V is effected to the transfer roller 2 in the subsequent sheet present period.

In order to accomplish this control, the voltage source 4 includes a holding circuit for holding a voltage (which may be lower than the 500V) corresponding to the detected voltage of the transfer roller 2. During the constant current control, this voltage is held, and in the subsequent sheet present period, the transfer roller 2 is constant-voltage-controlled with the voltage.

In this manner, when the size of the transfer sheet used is A4, the transfer current of 1.5 microamperes is provided which is sufficient for performing the good transfer operation.

When a small size sheet is used, the transfer current of 1.5 micro-amperes is provided since the voltage of 500V is maintained in the sheet present period, and therefore, the image transfer is proper.

During the sheet absent period, only 5 micro-amperes flows, as described hereinbefore, and therefore, no transfer memory of positive polarity does not remain on the surface of the OPC photosensitive member. Therefore, the foggy background is not produced in the subsequent image formation.

In the sheet absent region in the longitudinal direction of the transfer roller, that is, the difference region between a large size sheet and the small size sheet, the current density does not exceed that corresponding to approximately 5 micro-amperes, since the constant voltage control is effected during the sheet present period. Therefore, the transfer memory does not remain in the photosensitive member.

These apply to the L/L condition which will be dealt with below.

Under the L/L condition, when the similar constant current control is effected during the sheet absent period, the voltage of 2 KV is obtained from the transfer roller 2, and therefore, the constant voltage control is effected at 2 KV during the sheet present period. By this, the transfer current of 2 micro-amperes is obtained through the transfer roller 2 and therefore, the good transfer operation is performed.

In this manner, the constant current control is effected to the transfer roller 2 during the sheet absent period, and the constant voltage control is effected to the transfer roller 2 during the sheet present period, by which good image transfer performance can be provided at all times irrespective of the ambient conditions and the size of the transfer material, so that the foggy background resulting from the transfer memory can be prevented, and that the image quality is good.

In place of the transfer roller, a transfer belt is usable.

The constant current control may be effected during at least a part of the period in which the image region of the photosensitive member is not at the transfer position.

Further examples of the semiconductive transfer roller 2 will be described.

A transfer roller a was prepared in the same manner as in the previous example except for using a formulation comprising: 100 parts of an EPDM (trade name: EPT 4045, mfd by Mitsui Sekiyu Kagaku), 10 parts of zinc white (Zinc White No. 1), 2 parts of stearic acid, 100 parts of ZnO $Al_2O_3$, 2 parts of an accelerator "M" (trade name: Nocceler M, mfd. by Ouchi-Shinko Kagaku), 1 part of an accelerator "BZ" (trade name: Nocceler BZ, mfd. by Ouchi-Shinko Kagaku), 2 parts of sulfur, 5 parts of a foaming agent (trade name: Cellmic C, mfd. by Sankyo Kasei), 5 parts of a foaming aid (trade name: Cellton NP, mfd. by Sankyo Kasei); and 45 parts of HAF carbon as a reinforcing agent, and 60 parts of paraffin oil as an insulating oil.

Separately, a transfer roller b was prepared in the same manner as in the case of the transfer roller a described above except that 50 parts of the HAF carbon and 65 parts of the paraffin oil were used.

Further, a transfer roller c was prepared in the same manner as in the case of the transfer roller a described above except that 45 parts of the HAF carbon and 55 parts of the paraffin oil were used.

Separately, a composition comprising 150 parts of ZnO $Al_2O_3$, 100 parts of a silicone rubber (trade name: KE 520, mfd. by Shinetsu Kagaku), 2 parts of a silicone crosslinking agent (trade name: C8 mfd. by Shinetsu Kagaku), and 1.5 parts of AIBN was subjected to primary vulcanization (250° C., 20 min), and further subjected to secondary vulcanization (200° C., 4 hours). Then the resultant composition was formed into a transfer roller d.

Separately, a transfer roller e was prepared in the same manner as in the case of the transfer roller c described above except that 70 parts of $In_2O_3$ $SnO_2$ was used.

Further, a transfer roller f was prepared in the same manner as in the case of the transfer roller a described herein above except that 20 parts of HAF carbon, 70 parts of paraffin oil and 20 parts of Ketjen Black EC were used.

Further, a transfer roller 8 was prepared in the same manner as in the case of the transfer roller e described herein above except that 100 parts of $Fe_3O_4$ was used.

Hardnesses and electric resistances of the thus prepared transfer rollers a–g are shown in Table 2 appearing hereinafter.

Each of the transfer rollers a–g was assembled in an electrophotographic apparatus (laser-beam printer) as shown in FIG. 2 as a charging member for transfer operation, and subjected to image formation evaluation.

TABLE 2

| Transfer roller | a | b | c | d | e | f | g |
|---|---|---|---|---|---|---|---|
| Hardness*1 | 28 | 30 | 32 | 30 | 28 | 30 | 28 |
| Electric resistance (ohm) | $2 \times 10^8$ | $2 \times 10^9$ | $5 \times 10^8$ | $1 \times 10^9$ | $6 \times 10^8$ | $1 \times 10^5$ | $3 \times 10^{12}$ |
| Evaluation of image | ◎ | ◎ | ◎ | | | x*2 | x*2 |

◎: Excellent image quality as in the initial stage was provided even after copying of 100,000 sheets.
: Good image quality
x: Poor image
*1The hardness was measured by means of a measurement device (trade name: Asker C, mfd. by Kobunshi Keiki K.K.).
*2No good transfer under the L/L condition.

As will be understood from Table 2, the transfer roller comprising the double oxide in the elastomeric material provides a high quality image without contamination of the photosensitive member, insufficient charging or the current leakage, except for that the improper transfer occurs under the L/L condition when the resistance is not more than $1 \times 10^5$ ohm or not less than $3 \times 10^{12}$ ohm. The preferable range of the resistance is $10^8$–$10^{10}$ ohm. Here, the resistance is measured by providing a nip between the photosensitive member and the transfer roller and by actually applying a voltage between the nip and the core metal of the transfer roller. When the reinforcing material or the softening material is added in addition to the double oxide, the electric resistance can be stably controlled in the semiconductor region, and the photosensitive member is not contaminated by the ooze of the softening material, and furthermore, the durability is good.

The description will be made as to another way of control.

Figure 8:
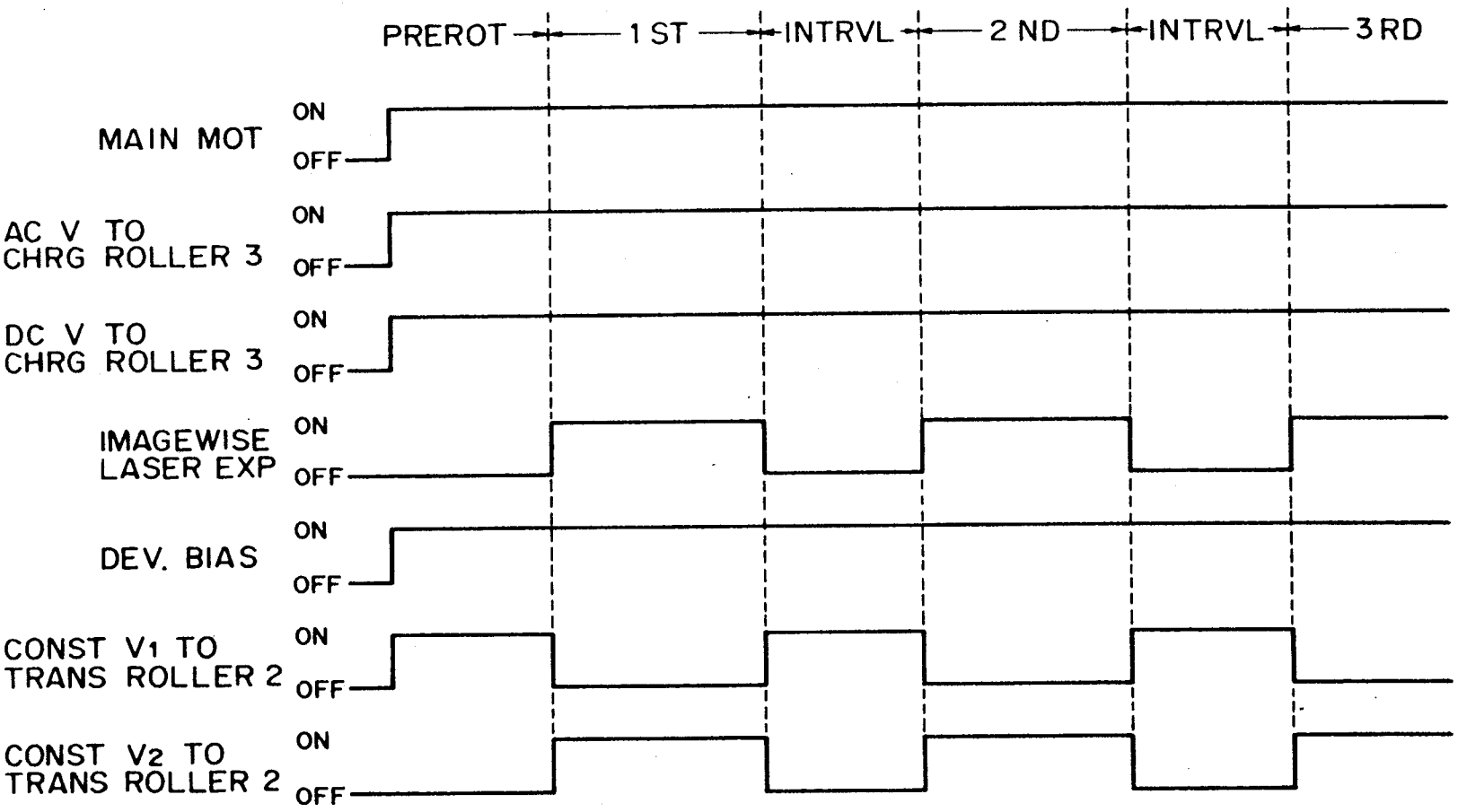
FIG. 8 is a timing chart relating to the operation of the apparatus of FIG. 7.
Figure 9:
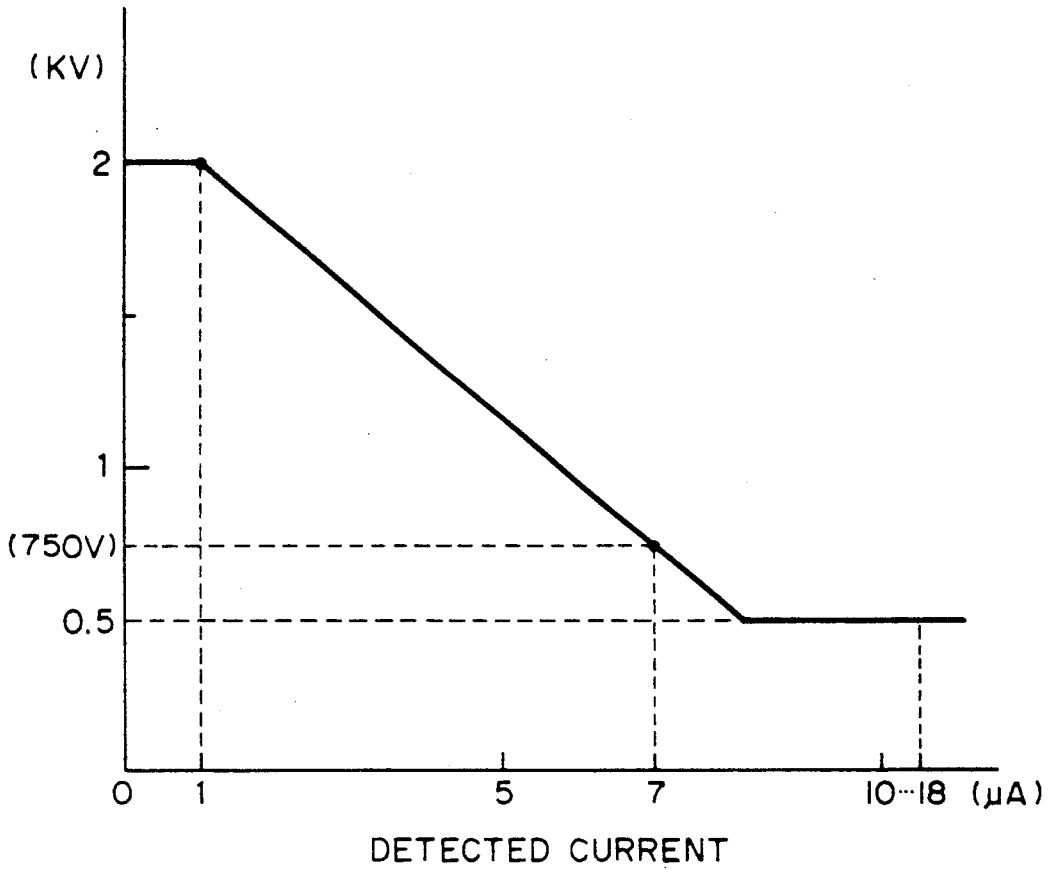
FIG. 9 is a graph for converting the detected current of the transfer roller to a voltage to the transfer roller.
Figure 10:
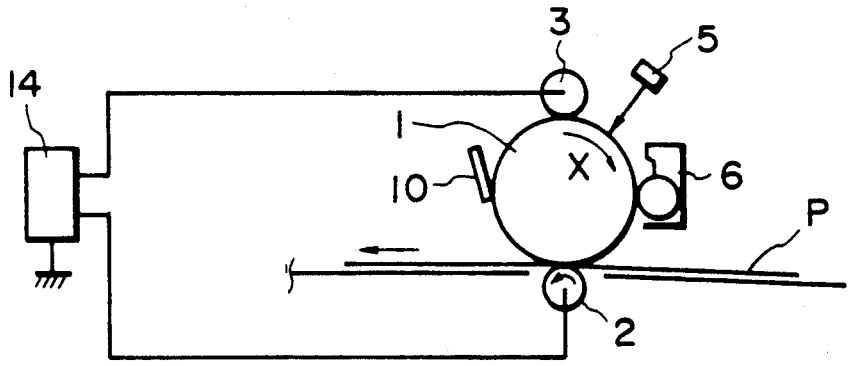
FIG. 10 is a sectional view of a conventional image forming apparatus.
Figure 11:
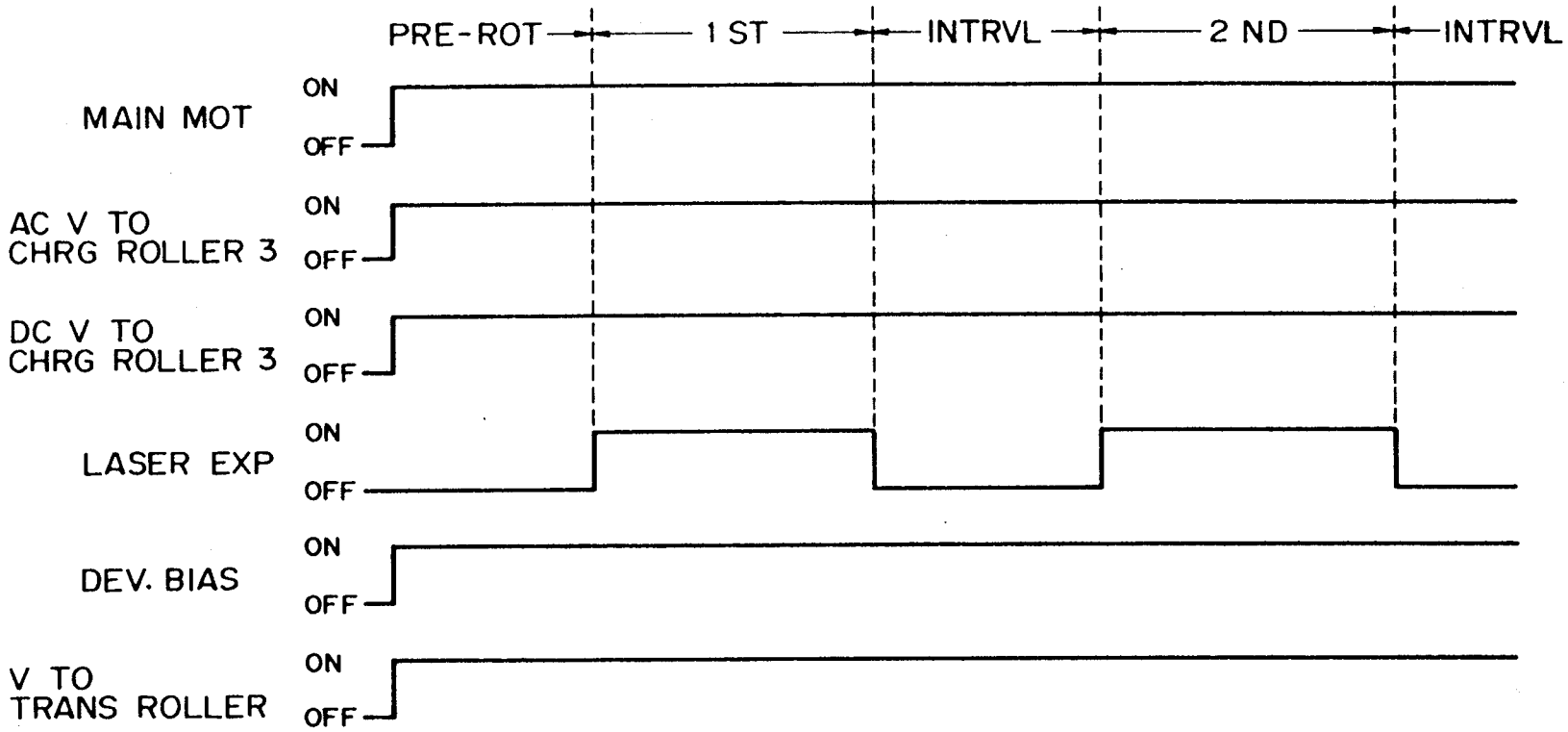
FIG. 11 is a timing chart of the conventional image forming apparatus to be compared with the apparatus of the present invention.
Figure 12:
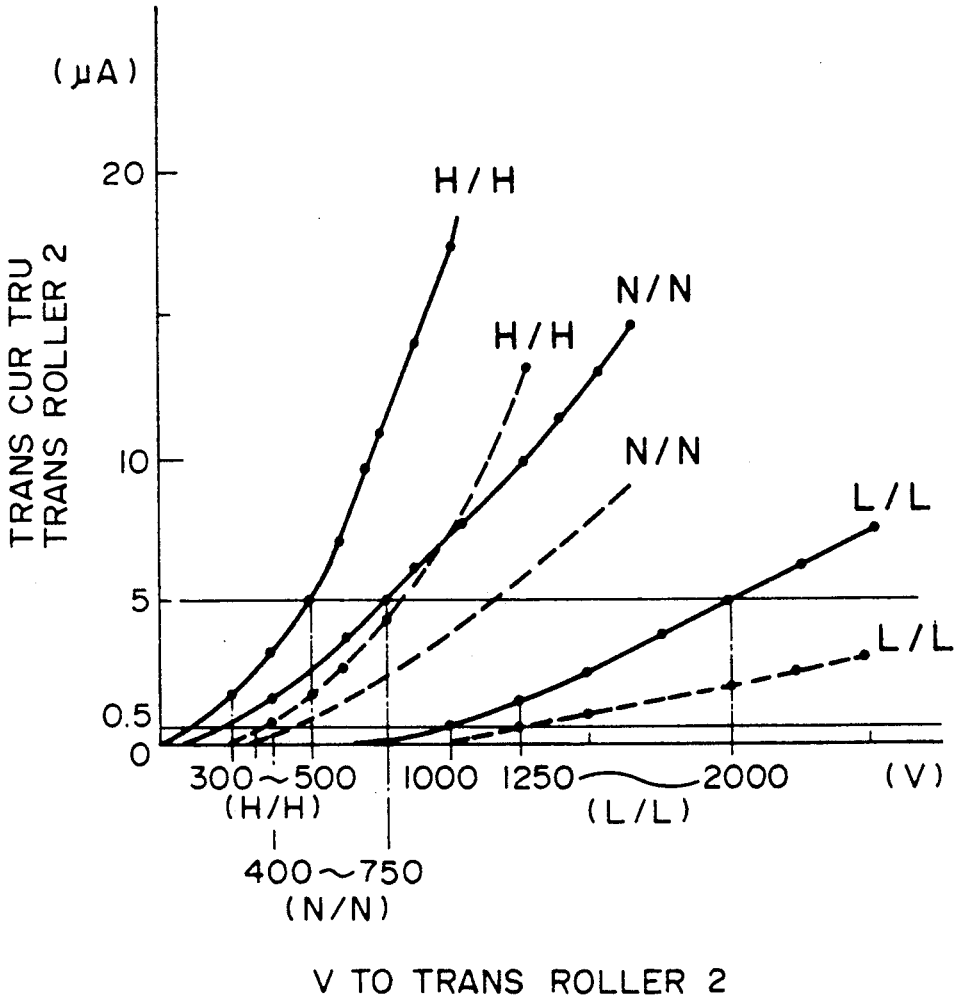
FIG. 12 is a graph of the V-I characteristics of a transfer roller.

FIG. 8 shows an image forming apparatus according to another embodiment of the present invention, and FIG. 8 shows the sequence of the operation thereof. In this embodiment, the constant voltage control is effected to the transfer roller 2 with the voltage V1 (1000V in this embodiment) determined during the pre-rotation period or the sheet interval period in which the non-image region of the photosensitive member is at the transfer position. The current flowing through the transfer roller 2 is detected by a transfer current detecting means 9, and the detected current is transmitted to the CPU. The CPU 8 looks up with a preset conversion table for converting the current to the voltage (for example, a graph of FIG. 9) to convert the detected current to a voltage V2. Then, it supplies a signal indicative of the voltage level V2 to a high voltage source 4. The voltage source 4 carries out the constant voltage control with the voltage level of V2 during the sheet present period in which the image region of the photosensitive member is in the transfer position. The constant voltage control to the transfer roller 2 with the constant voltage of V1 may be performed at least a part of duration in which the non-image area of the photosensitive member is at the transfer position.

When the transfer roller 2 which is exactly the same as the first embodiment, and when the constant voltage control is effected to the transfer roller with the voltage of 1000V during the pre-rotation period and the sheet interval period under the H/H condition, the transfer current detecting means 9 detects approximately 18 micro-amperes as will be understood from FIG. 6 (V-I characteristics). The CPU 8 uses the conversion table of FIG. 9 to set the voltage V2 to 500V corresponding to the detected current of 18 micro-amperes, and it controls the transfer roller at the constant voltage of 500V during the sheet present period. Then, similarly to the first embodiment, the transfer current of 1.5micro-amperes is provided during the sheet present period, and therefore, the good image transfer operation can be provided.

The similar control operation is effected under the N/N or L/L conditions, and the constant voltage control is effected at 750V and 2000V, respectively, by which good image can be outputted.

In this manner, the problems with the prior art are solved, so that the contact type image transfer system can be practicized.

In the foregoing embodiments, a transfer roller is used, but a transfer belt is usable in place of it.

In the foregoing embodiments, the transfer roller is in contact with the photosensitive member when the transfer material is not present at the transfer position. However, this is not limiting, and it is a possible alternative that a clearance smaller than a thickness of the transfer material is provided between the transfer roller and the photosensitive member, so that the transfer material is contacted to the transfer roller and the photosensitive member, when it is introduced into the transfer position.

As described in the foregoing, according to the present invention, the transfer charging member contactable to the backside of the transfer material and supplied with a voltage can be mass-produced with a desired resistance, and good image transfer performance can be provided at all times under any ambient conditions and irrespective of the sizes of the transfer material.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

image forming means for forming an image on said image bearing member;

transfer means for transferring an image from said image bearing member to a transfer material at a transfer position, wherein said transfer means is contactable to a backside of the transfer material at the transfer position and includes a charging member comprising a double oxide and means for applying a voltage to the charging member, and wherein said voltage applying means constant-voltage-controls the charging member when an image region of said image bearing member is at the transfer position, and constant-current-controls the charging member in at least a part of a period when the image region of said image bearing member is not at the transfer position, wherein a constant voltage for the constant voltage control is determined on the basis of the constant current control.

2. An apparatus according to claim 1, wherein the charging member is contactable to said image bearing member.

3. An apparatus according to claim 2, wherein the charging member includes an elastic member.

4. An apparatus according to claim 1 or 3, wherein the double oxide is a solid solution compound comprising zinc oxide and aluminum oxide.

5. An apparatus according to claim 1 or 3, wherein the charging member has a volume resistivity of $10^6$-$10^{13}$ ohm.cm

6. An apparatus according to claim 1 or 3, wherein the charging member contains 0.1-20% by weight of carbon black and 5-20% by weight of insulating oil.

7. An apparatus according to claim 3, wherein the elastic member contains 5-40% by weight of the double oxide.

8. An apparatus according to claim 1, wherein the image region of said image bearing member is a region in which a toner image is formed on said image bearing member.

9. An apparatus according to claim 8, wherein the image region is contactable with the transfer material.

10. An apparatus according to claim 1, wherein said at least the part of the period includes a period in which the image region is upstream of the transfer position.

11. An apparatus according to claim 1, 2 or 3, wherein the charging member is rotatable.

12. An apparatus according to claim 11, wherein the charging member is in the form of a roller.

13. An apparatus according to claim 1, wherein the constant voltage is determined on the basis of a voltage of said transfer means when the constant current control is effected

14. An apparatus according to claim 1, wherein the constant current control is effected when the transfer material is absent at the transfer position.

15. An apparatus according to claim 1, wherein said image forming means includes means for forming a latent image on said image bearing member.

16. An apparatus according to claim 15, wherein a voltage applied to the charging member in the constant voltage control has a polarity opposite to a polarity of the latent image.

17. An apparatus according to claim 1 or 16, wherein said image bearing member is a photosensitive member.

18. An apparatus according to claim 1 or 16, wherein said image bearing member is an organic photoconductor.

19. An image forming apparatus, comprising:

a movable image bearing member;

image forming means for forming an image on said image bearing member;

transfer means for transferring the image from said image bearing member onto a transfer material, wherein said transfer means is contactable to a backside of the transfer material at the transfer position and includes a charging member comprising a double oxide and voltage applying means for applying a voltage to the charging member, and wherein the voltage applying means constant-voltage-controls the charging member with a first voltage when an image region of said image bearing member is at the transfer position, and constant-voltage-controls the charging member with a second voltage in at least a part of a period when the image region is not at the transfer position, wherein the first voltage is determined on the basis of a current flowing through said transfer means when the charging member is constant-voltage-controlled with the second voltage.

20. An apparatus according to claim 19, wherein the charging member is contactable to said image bearing member.

21. An apparatus according to claim 20, wherein the charging member includes an elastic member.

22. An apparatus according to claim 19 or 21, wherein the double oxide is a solid solution compound comprising zinc oxide and aluminum oxide.

23. An apparatus according to claim 19 or 21, wherein the charging member has a volume resistivity of $10^6$–$10^{13}$ ohm.cm.

24. An apparatus according to claim 19 or 21, wherein the charging member contains 0.1–20% by weight of carbon black and 5–20% by weight of insulating oil.

25. An apparatus according to claim 21, wherein the elastic member contains 5–40% by weight of the double oxide.

26. An apparatus according to claim 19, wherein the image region of said image bearing member is a region in which a toner image is formed on said image bearing member.

27. An apparatus according to claim 26, wherein the image region is contactable with the transfer material.

28. An apparatus according to claim 19, wherein said at least the part of the period includes a period in which the image region is upstream of the transfer position.

29. An apparatus according to claim 19, 20 or 21, wherein the charging member is rotatable.

30. An apparatus according to claim 29, wherein the charging member is in the form of a roller.

31. An apparatus according to claim 19, wherein the constant voltage control with the second voltage is effected when the transfer material is not at the transfer position.

32. An apparatus according to claim 19, wherein said image forming means includes means for forming a latent image on said image bearing member.

33. An apparatus according to claim 32, wherein the voltage applied to the charging member when it is constant-voltage-controlled with the first voltage has a polarity opposite to that of the latent image.

34. An apparatus according to claim 19 or 33, wherein said image bearing member is a photosensitive member.

35. An apparatus according to claim 19 or 33, wherein said image bearing member is an organic photoconductor.

* * * * *

UNITED STATES PATENT AND TRADEMARK OFFICE

CERTIFICATE OF CORRECTION

PATENT NO. : 5,034,777

DATED : July 23, 1991

INVENTOR(S) : Yukihiro Ohzeki, et al

It is certified that error appears in the above-identified patent and that said Letters Patent is hereby corrected as shown below:

COLUMN 1

Line 43, "applied" should read --applies--.
Line 44, "imagewisely" should read --imagewise--.

COLUMN 2

Line 13, "In the" should read --The--.
Line 30, "following" should read --the following--.
Line 43, "following" should read --the following--.
Line 49, "By" should be deleted.
Line 50, "the" should read --The--.
Line 57, "containing" should read --where--.
Line 64, "following" should read --the following--.

COLUMN 3

Line 25, "absencen" should read --absence--.
Line 27, "prerotation" should read --pre-rotation--.

COLUMN 4

Line 23, "microampere" should read --micro-ampere--.
Line 63, "the problem that" should be deleted.

COLUMN 5

Line 51, "X, is" should read --X, and is--.
Line 53, "imagewisely" should read --imagewise--.

UNITED STATES PATENT AND TRADEMARK OFFICE

CERTIFICATE OF CORRECTION

PATENT NO. : 5,034,777

DATED : July 23, 1991

INVENTOR(S) : Yukihiro Ohzeki, et al

It is certified that error appears in the above-identified patent and that said Letters Patent is hereby corrected as shown below:

COLUMN 7

Line 27, "(or $Al_2O_3$);" should read --(or $Al_2O_3$),--.
Line 58, "those" should read --chosen from those--.

COLUMN 8

Line 6, "my" should read --the--.
Line 54, "(4,4'-oxybis(-" should read --(4,4'-oxybis--.

COLUMN 10

TABLE 1, "2 X $10^5$ ohm · cn" should read --2 X $10^5$ ohm · cm--.
Line 33, "As" should read --As is--.
Line 47, "ohm." should read --ohm--.
Line 48, "ohm." should read --ohm--.

COLUMN 11

Line 15, "supplied" should read --supplies--.
Line 32, "the" should read --effects the-- and "is" should be deleted.
Line 33, "effected" should be deleted.
Line 34, "which" should be deleted.

COLUMN 12

Line 4, "wherein" should read --,--.
Line 20, "micro-ampere" should read --micro-amperes--.
Line 34, "microamperes" should read --micro-amperes--.
Line 41, "only" should read --a current of only--.

UNITED STATES PATENT AND TRADEMARK OFFICE

CERTIFICATE OF CORRECTION

PATENT NO. : 5,034,777

DATED : July 23, 1991

INVENTOR(S) : Yukihiro Ohzeki, et al

It is certified that error appears in the above-identified patent and that said Letters Patent is hereby corrected as shown below:

COLUMN 12

Line 42, "no" should read --the--.
Line 55, "These apply" should read --This applies--.

COLUMN 13

Line 37, "Kasei); and" should read --Kasei),--.
Line 51, "C8" should read --C8,--.
Line 66, "roller 8" should read --roller g--.

COLUMN 14

TABLE 2, "

| d | e |
|---|---|
| 30 | 28 |
| $1 \times 10^9$ | $6 \times 10^8$ " |

should read

--

| d | e |
|---|---|
| 30 | 28 |
| $1 \times 10^9$ | $6 \times 10^8$ |
| O | O |

-- and " :Good image quality" should read
--O:Good image quality--.

Line 25, "for" should be deleted.
Line 52, "with" should be deleted.
Line 63, "duration in" should read --the duration of--.
Line 65, "which" should be deleted.

UNITED STATES PATENT AND TRADEMARK OFFICE

CERTIFICATE OF CORRECTION

PATENT NO. : 5,034,777

DATED : July 23, 1991

INVENTOR(S) : Yukihiro Ohzeki, et al

It is certified that error appears in the above-identified patent and that said Letters Patent is hereby corrected as shown below:

COLUMN 15

Line 9, "1.5micro-" should read --1.5 micro- --.
Line 20, "practicized." should read --practiced.--.
Line 50, "member;" should read --member; and--.

COLUMN 16

Line 54, "member;" should read --member; and--.

Signed and Sealed this

Twenty-third Day of March, 1993

*Attest:*

STEPHEN G. KUNIN

*Attesting Officer*

*Acting Commissioner of Patents and Trademarks*